United States Patent [19]

Morioka et al.

[11] Patent Number: 4,664,061

[45] Date of Patent: May 12, 1987

[54] SPRAYING BOOTH

[75] Inventors: Koji Morioka, Amagasaki; Hideaki Tojo, Saitama; Kazuo Kimura, Tokyo; Susumu Yoshida, Nara, all of Japan

[73] Assignees: Taikisha Ltd.; Honda Giken Kogyo Kabushiki Kaisha, both of Tokyo, Japan

[21] Appl. No.: 790,855

[22] Filed: Oct. 24, 1985

[30] Foreign Application Priority Data

Oct. 26, 1984 [JP] Japan ..... 59-226091
Oct. 26, 1984 [JP] Japan ..... 59-226092
Oct. 31, 1984 [JP] Japan ..... 59-229998

[51] Int. Cl.[4] ..... B05B 15/12

[52] U.S. Cl. ..... 118/663; 118/326; 118/DIG. 7; 55/DIG. 46; 98/115.2

[58] Field of Search ..... 118/326, 663, DIG. 7; 55/DIG. 46; 98/115.2

[56] References Cited

U.S. PATENT DOCUMENTS 3,807,291 4/1974 Roberts et al. ..... 98/115.2

FOREIGN PATENT DOCUMENTS 2936367 3/1981 Fed. Rep. of Germany ..... 118/326
2156238 10/1985 United Kingdom ..... 55/DIG. 46

*Primary Examiner*—Shrive P. Beck
*Attorney, Agent, or Firm*—Webb, Burden, Robinson & Webb

[57] ABSTRACT

A spraying booth comprising a spraying area defined by a ceiling and side walls. The ceiling includes top feed openings connected with a feed duct extending from a conditioner for controlling a fresh air temperature. The side walls include side feed openings connected with a blast duct for supplying air from which paint mist has been removed at mist removing devices. Fresh air supplied through the top feed openings and the mistless air supplied through the side feed openings combine to produce an advantageous atmospheric condition for a paint spraying operation.

20 Claims, 15 Drawing Figures

SPRAYING BOOTH

BACKGROUND OF THE INVENTION

This invention relates to a spraying booth for spraying paint on automobile bodies, casings for household electric appliances and other articles. This type of spraying booth comprises a spraying area, top feed openings to introduce a temperature conditioned air in laminar flows substantially through an entire ceiling area and downwardly into the spraying area, side feed openings to introduce the temperature conditioned air through side walls thereof in substantially horizontal directions into the spraying area, and exhaust openings to discharge a mist of overspray paint together with the temperature conditioned air from the spraying area through a position below a painted object standing at a spraying position. A confluence of the temperature conditioned air introduced in the downward laminar flows and the temperature conditioned air introduced in the horizontal flows and an exhausting action taking place below the painted object combine to produce an air flow condition in the spraying area suitable for the spraying operation, i.e. to cause the air flows to concentrate upon the painted object.

A known spraying booth is illustrated in FIG. 15 of the accompanying drawings. As seen, a temperature conditioned fresh air is delivered from a conditioner 17 into a spraying area 1 through both top feed openings 3 and side feed openings 4. The temperature conditioned air is discharged together with the mist of overspray paint from the spraying area 1 through exhaust openings 5. The air is released to the ambient after being dispossessed of the mist at mist removing devices 11 and 14. In the drawing, number 20 denotes a feed fan, number 21 denotes an exhaust fan, number 7 denotes automatic spraying robots, reference A denotes a painted object, number 15 denotes a fresh air intake duct, and number 16 denotes a dust filter.

However, the known spraying booth noted above has the disadvantages that, where the spraying area is ventilated with great frequency in order to discharge the mist of overspray paint promptly therefrom, a correspondingly large amount of air must be treated by the conditioner and must be disposed of from the mist removing devices, which requires the conditioner and feed fan to have large capacities and increases equipment and running costs. Moreover, the total thermal efficiency tends to be poor because of great heat loss resulting from the disposal of the air dispossessed of the mist outside the apparatus.

SUMMARY OF THE INVENTION

The object of this invention is to provide a spraying booth incorporating rational improvements in the supply mode of a temperature conditioned air with respect to top and side feed openings, whereby the apparatus taken as a whole has improved thermal efficiency with small capacity fans and conditioner while securing a necessary ventilating frequency and without injuring the intrinsic performance of this type of spraying booth.

In order to achieve the above object, a spraying booth according to this invention comprises a spraying area defined by a ceiling and side walls, top feed openings for introducing a temperature conditioned air in laminar flows substantially through an entire area of the ceiling and downwardly into the spraying area, the top feed openings being connected with a feed duct, side feed openings for introducing the temperature conditioned air through the side walls in substantially horizontal directions into the spraying area, the side feed openings being connected with a blast duct, and exhaust openings for removing a mist of overspray paint together with the temperature conditioned air from the spraying area through a position below a painted object standing at a spraying position in the spraying area, wherein the top feed openings are adapted to receive a temperature conditioned fresh air supply through the feed duct, and the side feed openings are adapted to receive through the blast duct an exhaust air having undergone a paint mist removing treatment.

The spraying booth according to this invention as described above has the advantages of requiring a conditioner and a feed fan having only small capacities, permitting the apparatus taken as a whole to have improved thermal efficiency, greatly reducing equipment and running costs, and achieving significant energy saving.

The starting point of this invention having the above advantages was researches on the functional effects produced by the substantially horizontal delivery of the temperature conditioned air through the feed openings in the side walls. These functional effects are as follows:

(a) The horizontal air flows deflect the downward laminar flows from above toward the painted object, thereby to prevent floating paint mist descending with the downward flows from adhering to and accumulating on surrounding walls and equipment such as spraying robots.

(b) The deflection provides for smooth discharge of the temperature conditioned air in the spraying area through the exhaust openings disposed below the painted object and promotes smooth disposal of the mist of overspray paint.

(c) The deflected flows and the exhausting action taking place below the painted object combine to produce a flow condition in the spraying area such that the air flows are all directed toward the painted object, thereby to improve adhering efficiency of the sprayed paint with respect to the painted object and to check spread of the mist of overspray paint in the spraying area.

It has been found after thoroughgoing researches that the air introduced in horizontal flows is discharged in a short-circuiting fashion through the exhaust openings, without contacting the painted object to any significant extent, entraining the mist of overspray paint floating in upper portions of the spraying area.

Therefore, even if the temperature conditions of the horizontally introduced air flows may somewhat be deteriorated and such air flows may have slight organic gas contents, temperature conditions surrounding the painted object are maintained satisfactory and the essential purposes of the horizontally directed air flows as set out in the paragraphs (a), (b) and (c) above are sufficiently fulfilled so long as the fresh and well temperature conditioned air is introduced in laminar flows downwardly through the top feed openings and unless the air introduced in horizontal flows through the side openings contains a large amount of paint mist or dust.

Thereupon attention has been directed to the facts that the air having undergone the treatment at the mist removing devices still retains a considerable amount of heat resulting from the temperature conditioning and that the air has been dispossessed of almost all of the paint mist although it contains organic gas in a small amount. Thus, the top feed openings are adapted to receive the temperature conditioned fresh air supply through the feed duct, and the side feed openings are adapted to receive through the blast duct the exhaust air from the spraying area having undergone the paint mist removing treatment. This arrangement, while securing a certain frequency of spraying area ventilation to fully retain the intrinsic performance of this type of spraying booth with respect to the temperature of the atmosphere surrounding the painted object and the mist removing efficiency, permits the spraying booth to have a reduced amount of fresh air treated at the conditioner compared with the case of a conventional spraying booth set to an equal frequency of ventilation. Furthermore, this arrangement is capable of reducing the amount of air to be ultimately disposed of outwardly of the booth and accordingly the heat loss resulting from the disposal.

In a preferred form of the spraying booth according to this invention, the air feed duct and the blast duct may include flow control devices such as fans or blowers, respectively. In another preferred form the side feed openings may be vertic lly adjustable according to a height of the painted object. Both these cases optimize the above noted effects produced by the confluence of the air introduced to flow downwardly and the air introduced in horizontal directions.

Other objects and advantages of this invention will be apparent from the following description.

DETAILED DESCRIPTION OF THE PREFERRED EMBODIMENTS

Figure 1:
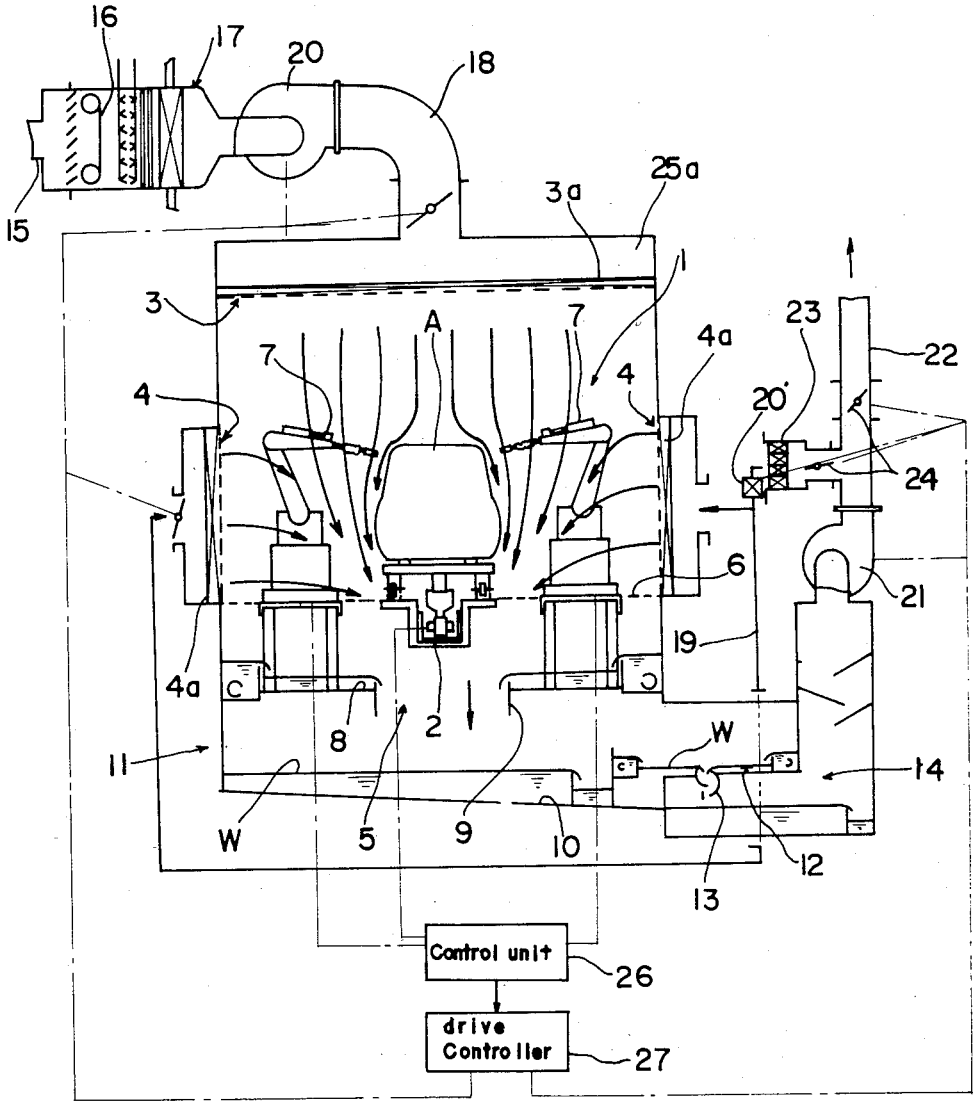
FIG. 1 is a schematic sectional front view of a spraying booth embodying this invention.
Figure 2:
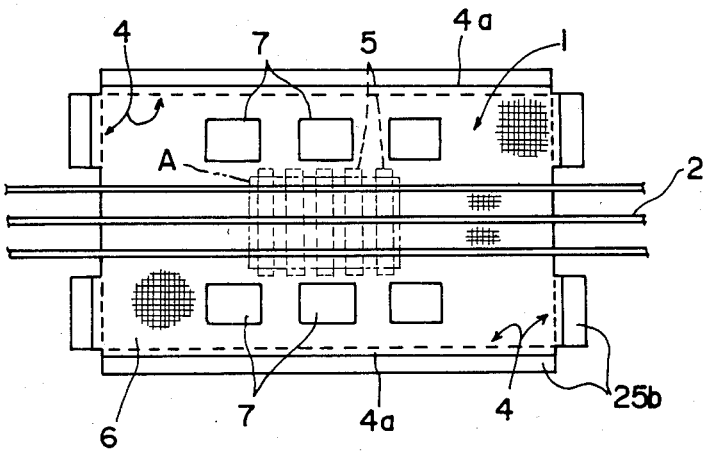
FIG. 2 is a schematic sectional plan view of the spraying booth.

A preferred embodiment of this invention will be described with reference to FIGS. 1 and 2.

A spraying booth embodying this invention comprises a spraying area 1 in a chamber form and a conveyor 2 for bringing objects A under painting treatment into and out of the spraying area 1. A ceiling of the spraying area 1 defines top feed openings 3 to introduce temperature conditioned air in laminar flows substantially through an entire ceiling area and downwardly into the spraying area 1. Four side walls of the spraying area 1 define side feed openings 4 in lower halves thereof, respectively, to introduce the temperature conditioned air in laminar flows in substantially horizontal directions toward the center of the spraying area 1. A plurality of exhaust openings 5 in slit form are provided directly under a position at which the object A stands to be sprayed with paint and which is defined centrally of the spraying area 1, to forcibly discharge a mist of overspray paint together with the air from the spraying area 1. A confluence of the air introduced in downward flows and the air introduced in horizontal flows and an exhausting action at the position directly under the painted object A combine to cause the air in the spraying area 1 to concentrate on the painted object A. The concentrating air flows are effective to enable high efficiency spraying upon the object A and prompt discharge of the mist of overspray paint.

In the drawings, reference numbers *3a* and *4a* denote final filters provided for the respective feed openings 2 and 4, number 6 denotes a grating floor and number 7 denotes automatic spraying robots.

A bottom wall defining the exhaust openings 5 comprises a first flowing water pan 8 to receive the air and aggregates of paint descending from the spraying area 1 through the grating floor 6. Each of the slit-like exhaust openings 5 comprises a short straight pipe passage 9 to cause the exhaust air to pass downwardly therethrough at high velocity in a constricted manner together with water overflowing from the pan 8 and flowing down inner walls of the passage 9 to prevent the paint from adhering to the inner walls. A purifying water vessel 10 storing water W is disposed below the pipe passages 9, and the exhaust air shooting at high velocity from the pipe passages 9 strikes against the water W whereby the paint mist contained in the exhaust air is trapped in the water W. These elements constitute a first mist removing device 11. A second mist removing device 14 is disposed downstream of the first mist removing device 11. The second mist removing device 14 comprises a second flowing water pan 12 and S-shaped winding pipe passages 13. The exhaust air arriving at the second mist removing device 14 has been dispossessed at the first mist removing device 11 of large paint mist particles and aggregates of paint. This exhaust air is caused to flow down the winding pipe passages 14 at high velocity confluently with water overflowing from the second flowing water pan 12. At this time centrifugal forces resulting from the high velocity flows through the winding passages 13 cause small paint mist particles remaining in the exhaust air to be trapped in the water W flowing down confluently therewith.

The temperature conditioned air is supplied to the top openings 3 and side openings 4 by the following mechanism. The top openings 3 are connected with a feed duct 18 extending from an air conditioner 17 which adjusts the temperature and humidity of fresh air taken in from the ambient through an air intake duct 15 and a dust filter 16. The side openings 4 are connected with a blast duct 19 through which the side openings 4 are supplied with the exhaust air dispossessed of the paint mist particles at the second mist removing device 14. Thus, the mistless exhaust air is reused as the temperature conditioned air to be introduced into the spraying area 1 while retaining a considerable amount of heat resulting from the temperature conditioning.

The feed duct 18 includes a feed fan 20 while the blast duct 19 includes a blast fan 29'. Number 22 denotes an exhaust duct including an exhaust fan 21. Number 23 denotes an intermediate filter and number 24 denotes flow control dampers. Number 25*a* denotes an upper chamber, and number 25*b* denotes side chambers.

Number 26 denotes an automatic control unit for actuating the conveyor 2 and the spraying robots 7 in a coordinated manner according to a preset program. This enables the objects A to be brought into and out of the spraying area 1 to be sprayed therein continuously or successively. Number 27 denotes a drive controller for a flow control device comprising the blast fan 20' and the flow control dampers 24.

Figure 3:
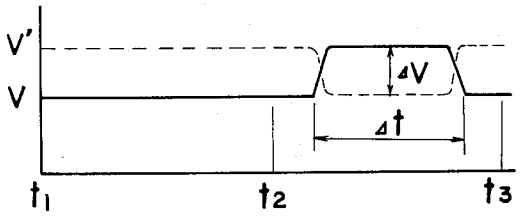
FIG. 3 is a graph showing a mode of ventilating a spraying area in the booth.

The automatic control unit 26 is operable according to the preset program and through the drive controller 27 and the dampers 24 to effect ventilation of the spraying area 1 for removal therefrom of the paint mist as shown in FIG. 3. In the continuous spraying operation by the automatic control unit 26, an amount V of ventilating air supplied downwardly through the top feed openings 3 and an amount V' of ventilating air supplied in horizontal directions through the side feed openings 4 are maintained to predetermined constant amounts, respectively, during a spraying process t1–t2 in which the object A under the spraying treatment is standing at or moving through the spraying position. For a predetermined time Δt during an object changing process t2–t3 which is from a time t2 of completion of the spraying treatment for the object A to a time t3 of arrival at the spraying position of a next object A', the amount V of air supplied downwardly is increased by a predetermined amount ΔV and the amount V' of air supplied in horizontal directions is decreased by a corresponding amount so that a sum of the amount V and the amount V' is maintained substantially constant through the spraying process and the object changing process.

Thus the paint mist removal takes place with a greater faculty during the object changing process than during the spraying process which is effected by increasing the amount V of air supplied downwardly and decreasing the amount V' of air supplied in horizontal directions. The greater downward supply of air will promote doward flows of air in the spraying area 1 which is furthered by the reduction in the horizontal supply of air, whereby the mist is discharged downwardly in an efficient manner. The prompt discharge of the paint mist during the object changing process is important since residual paint mist in the spraying area 1 would cause what is known as color migration, i.e. an undesirable situation where paint mist produced during a preceding spraying operation adheres to a next object which is sprayed with a different color paint.

While in the described example the sum of the amounts V and V' is maintained constant by varying only the ratio between the amount V of ventilating air supplied downwardly and the amount V' of air supplied horizontally, the increase and decrease may be effected in different amounts or the amounts V and V' of air supply during the spraying process may be increased or decreased as appropriate.

Instead of varying the amount V of air supplied downwardly and the amount of air supplied in horizontal directions by actuating the dampers to control divided flow ratios as in the foregoing embodiment, the supply amount variations may be effected by other means of control such as by controlling rotational frequencies of the feed fans provided respectively for the downward supply and the horizontal supply.

The invention permits the objects under spraying treatment to be brought into and out of the spraying area 1 one after another at short intervals while positively preventing color migration by controlling the ventilating air supplies for the spraying area 1. This arrangement is effective to greatly improve the efficiency of continuous spraying operation.

Furthermore, since the amount of air supplied in horizontal direction is decreased when the amount of air supplied dwnwardly is increased during the object changing process, the total amount of air supply is maintained substantially the same as in the spraying process or an increase in the total amount, if any, is minimized. This feature has the advantage of requiring small power for the ventilation of the spraying area and hence a small running cost and energy saving, compared with the case of increasing the downward supply and discharge of air while maintaining the horizontal supply of air to a constant amount.

Figure 4:
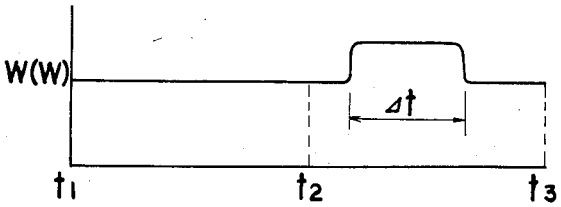
FIG. 4 is a graph showing another ventilating mode.

As a further example of advantageous control of the ventilating air through the spraying area 1, the amount of air supplied downwardly through the ceiling of the spraying area 1 and the amount of exhaust air discharged through the bottom thereof may be increased during the object changing process which is from the time of completion of the spraying operation for one object to the time of arrival at the spraying position of a next object. This example will particularly be described referring to FIG. 4.

The automatic control unit 26 is operable according to the preset program to control rotational frequencies of the feed fan 20 and the exhaust fan 21. In the continuous spraying operation by the automatic control unit 26, an amount W of ventilating air supplied downwardly through the top feed openings 3 and an amount W' of exhaust air discharged through the bottom of the spraying area 1 are maintained to predetermined constant amounts, respectively, during a spraying process t1–t2 in which the object A under the spraying treatment is standing at or moving through the spraying position. For a predetermined time Δt during an object changing process t2–t3 which is from a time t2 of completion of the spraying treatment for the object A to a time t3 of arrival at the spraying position of a next object A', the amount W of air supplied dwnwardly and the amount W' of exhaust air are increased by predetermined amounts ΔW and ΔW', respectively.

Thus the paint mist removal takes place with a greater faculty during the object changing process than during spraying process which is effected by automatically increasing the amount W of air supplied downwardly and the amount W' of exhaust air. In this way residual paint mist which would cause color migration is discharged promptly from the spraying area 1 for the sake of efficient operation.

FIGS. 5 through 8 show a still further example of advantageous control means for the ventilating air flows and in particular means for controlling the air supply through the side openings.

Figure 5:
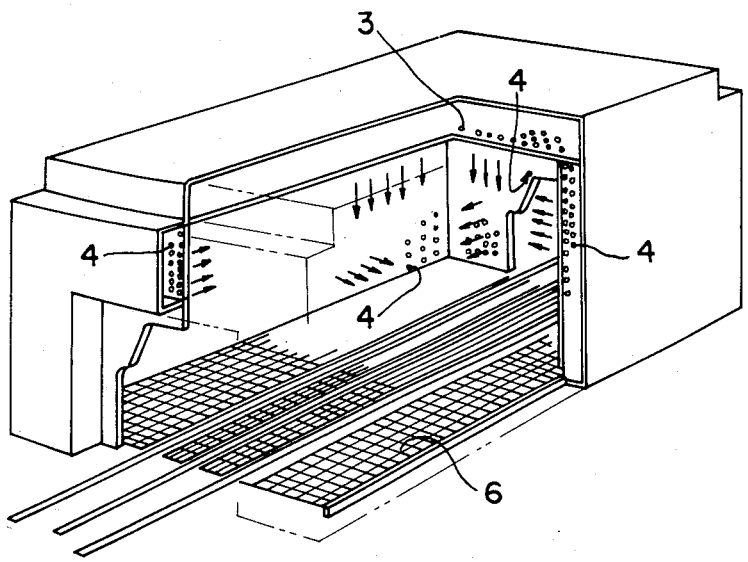
FIG. 5 is a partly broken away perspective view showing air feed openings according to this invention, FIGS. *6a* and *6b* are views showing construction and operation of a flow control device according to this invention, respectively, FIGS. *7a* and *7b* are schematic views in vertical section showing ventilating air flows in the spraying area, respectively.
Figure 7:
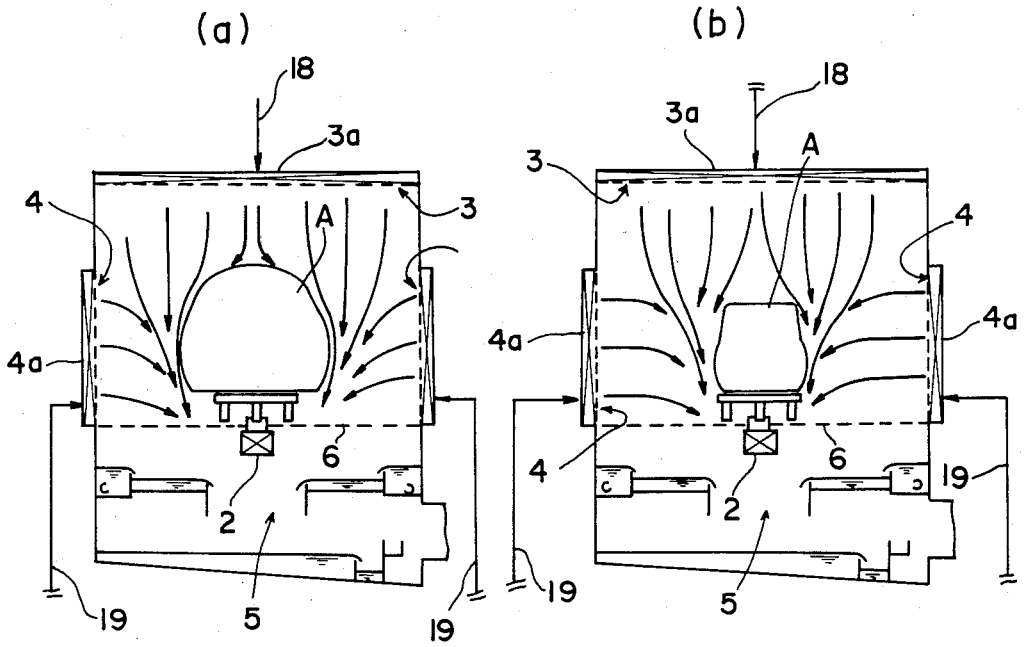
Figure 6:
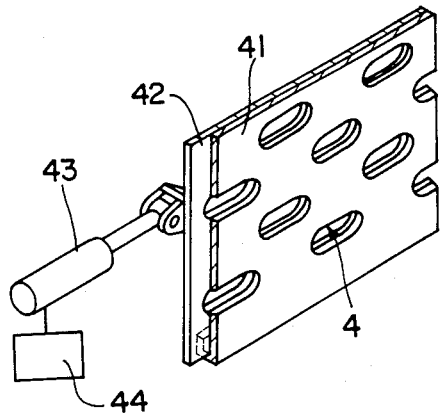
Figure 6:
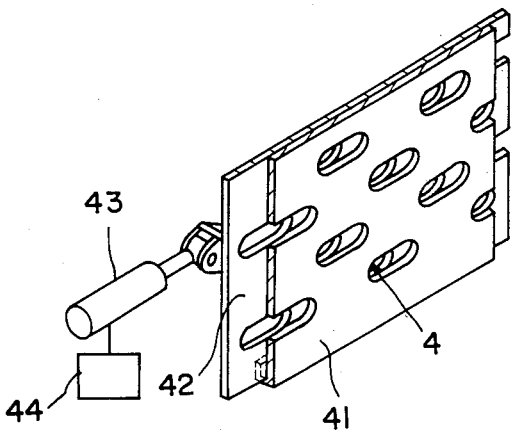

As described hereinbefore, the spraying area 1 has the ventilating system comprising the top feed openings 3 extending substantially over the entire area of its ceiling. The air is delivered under pressure by the feed fan 20 through the upper chamber 25*a* and the filter 3*a* into the spraying area 1 in downward laminar flows. The spraying area 1 has right and left lateral walls and front and rear walls including punched plates defining the side feed openings 4 in lower portions in a range of one third to two thirds of their height, preferable in lower halves thereof, respectively, as schematically shown in FIG. 5. The air is delivered under pressure by the feed fan 20' through the side chambers 25*b* and the filters 4*a* into the spraying area 1 in horizontal laminar flows.

The exhaust openings 5 in slit form are arranged below the position at which the object A stands still to be painted, for venting the air from the spraying area 1. This arrangement causes the ventilating air entering through the top openings 3 and the ventilating air entering through the side openings 4 to join one another and flow in confluence substantially all toward and concentrating on the object A and out through the exhaust openings 5 below the object A. The smooth concentrated flows of ventilating air achieve prompt discharge of the mist of overspray paint and improved paint adhesion to the object. The ventilating air flows introduced in horizontal directions act to deflect the downflows of mist containing air toward the object A and away from the spraying machines 7 surrounding the object A, thereby to prevent the paint from adhering to the spraying machines 7.

Referring to FIGS. 6*a* and 6*b*, the side feed openings 4 in each side wall are defined by a stationary punched plate 41 facing the spraying area 1 and a movable punched plate 42 extending over an entire back face of the stationary punched plate 41 and slidable relative thereto by a stroke device 43. By a relative sliding movement of the two punched plates 41 and 42 effected by operating the stroke device 43 to vary relative positions between perforations in these plates, an effective opening area of each side opening 4 is varied which results in a change in the amount of air supplied through the side openings in horizontal directions. The stroke device 43 is provided with a manual controller 44 for controlling an amount of movement of the stroke device 43 or an amount of displacement of each of the movable punched plates 42. By manually operating the controller 44 the amount of air supplied horizontally is varied to adjust the confluent state of the downward flows and horizontal flows of ventilating air. In this way the confluent flow of ventilating air is directed all toward the object A according to the shape and size of the object A as shown in FIGS. 7*a* and 7*b*.

Figure 8:
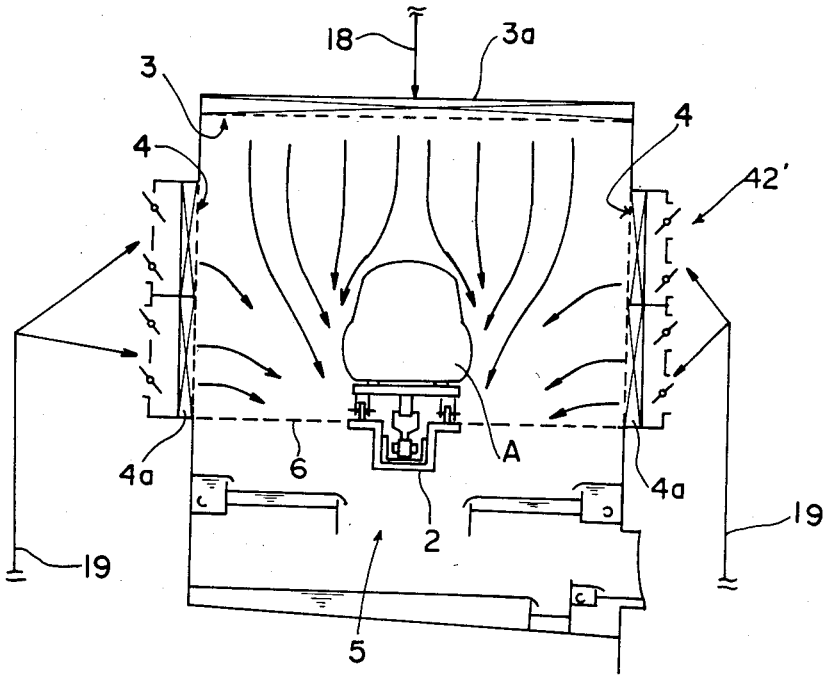
FIG. 8 is a schematic view in vertical section showing a modified flow control device.

In certain situations the front and rear walls may include no feed openings. As shown in FIG. 8, remote control type dampers 42' may be provided for the feed openings 4 in the respective side walls to vary the amount of air supply therethrough. Flow control dampers may be mounted in the ducts extending from the feed fan 20 to the respective chambers 25*b*. Further, a fan whose power is variable by controlling its rotational frequency or vane angle may be employed as the feed fan exclusively for the side openings 4. Thus, the control means for controlling the amount of air supply through the side openings may take varied forms and the above noted examples are collectively called herein a flow control device. Instead of the device for varying the amount of air supply through the openings in each side wall, a device may be provided to vary the amount of air supply through the openings in all of the side walls all together.

The specific constructions of the top feed openings 3 and the side feed openings 4 are variable in many ways.

The described flow control device for varying the amount of air introduced through the side openings 4 into the spraying area 1 enables adjustment of the confluence of the downflowing ventilating air and the horizontal ventilating air flows. This realizes optimal air flow conditions inside the spraying area 1 for prompt discharge of floating paint mist particles from the spraying area 1, prevention of paint adhesion to the surrounding walls and the equipment 7 installed in the spraying area 1, and improved painting efficiency regardless of the shape and size of the painted object A. Furthermore, the flow control device is effective to cause the air flows in the spraying area 1 to concentrate upon the painted object A in a manner suited to its shape and size, as shown in FIGS. 7*a* and 7*b*.

Figure 9:
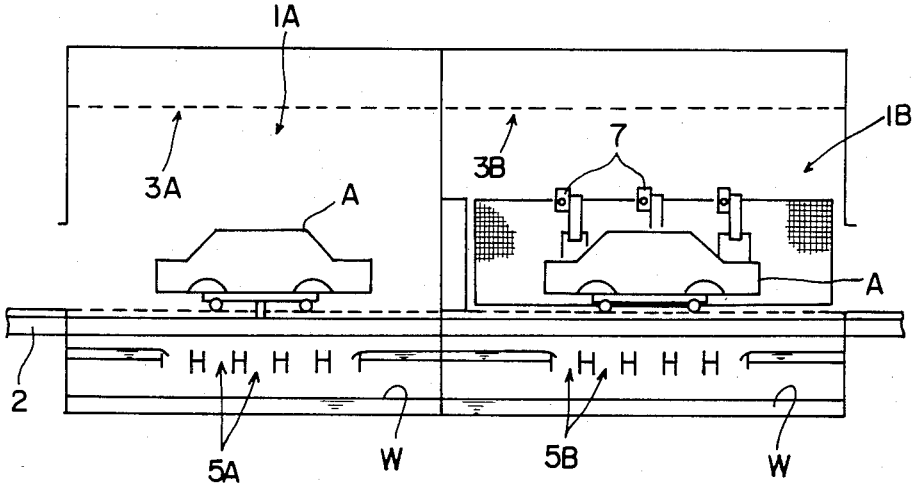
FIG. 9 is a schematic sectional side view of a further embodiment of this invention.
Figure 10:
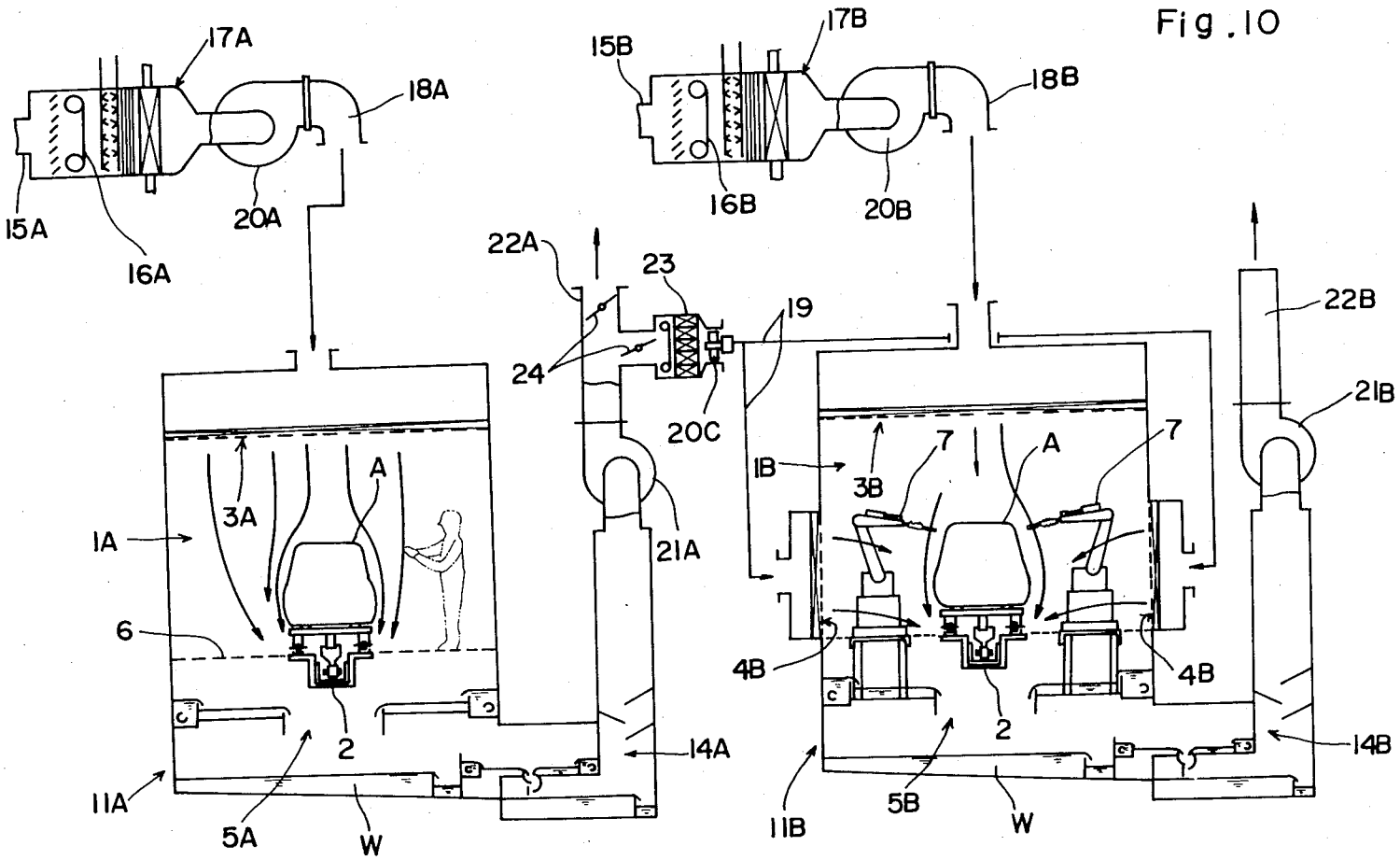
FIG. 10 is a schematic sectional front view of the further embodiment.
Figure 11:
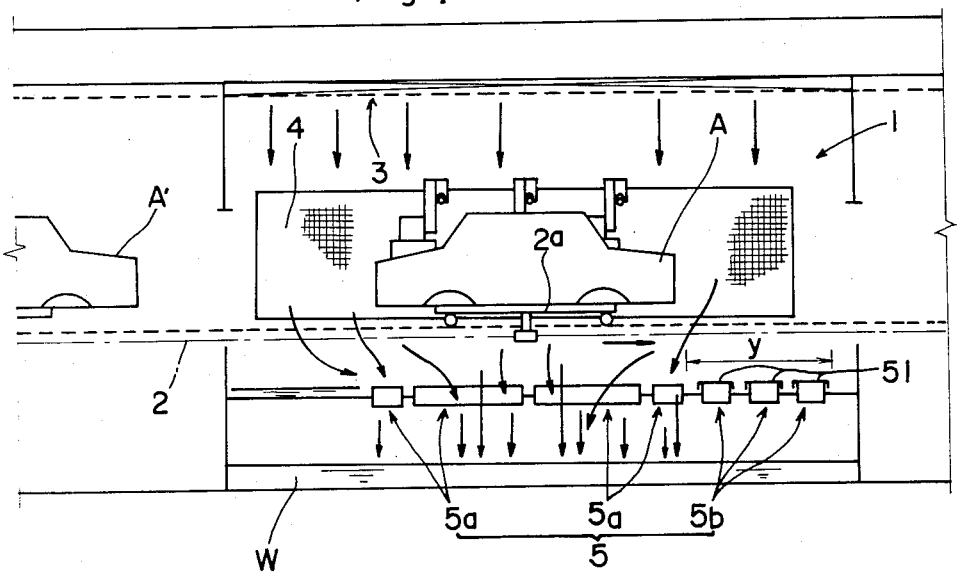
FIG. 11 is a schematic sectional side view showing an exhaust position shifting device according to this invention.
Figure 12:
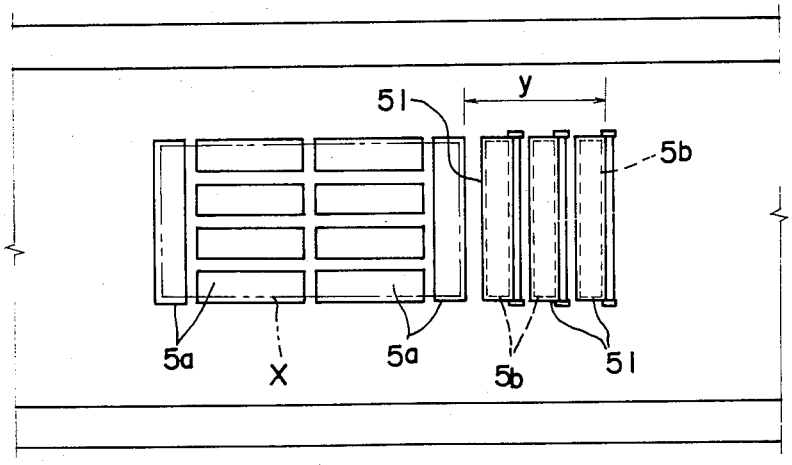
FIG. 12 is a plan view of the exhaust position shifting device.
Figure 13:
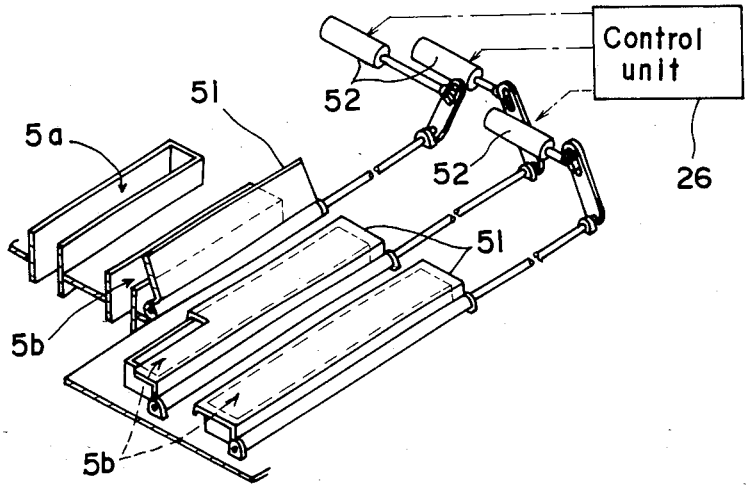
FIG. 13 is an enlarged perspective view of the exhaust position shifting device, FIG. 14 an enlarged side view of a modified exhaust position shifting device, and FIG. 15 a schematic sectional view of a prior art spraying booth.

A further embodiment of the invention will be described hereinafter with reference to FIGS. 9 and 10.

The illustrated spraying booth comprises a first spraying area 1A where the object A is manually sprayed with paint and a second spraying area 1B where the object A is automatically sprayed with paint by robots 7. The two spraying areas 1A and 1B are arranged side by side along an object carrying conveyor 2. A ceiling of each of the spraying areas 1A and 1B defines top feed openings 3A or 3B to introduce temperature conditioned air in laminar flows substantially through an entire ceiling area and downwardly into the spraying area. Each spraying area 1A or 1B includes exhaust openings 5A or 5B disposed below the painted object A, and mist removing devices 11A and 14A or 11B and 14B below the exhaust openings 5A or 5B for removing paint mist contained in exhaust air discharged from the spraying area through the exhaust openings by causing the exhaust air to collide at high velocity with purifying water W. The second spraying area 1B for automatic spraying operations further includes side feed openings 4B in four side walls thereof to introduce the temperature conditioned air in substantially horizontal directions into the second spraying area 1B.

The top feed openings 3A and 3B of the first and second spraying areas 1A and 1B, respectively, are connected with feed ducts 18A and 18B extending from a first and a second air conditioners 17A and 17B which adjust the temperature of fresh air taken in from the ambient through air intake ducts 15A and 15B and dust filters 16A and 16B. The side feed openings 4B of the second spraying area 1B are connected with a blast duct 19 through which the side openings 4 are supplied with the exhaust air dispossessed of the paint mist particles at the mist removing devices 11A and 14A of the first spraying area 1A. Thus, the mistless exhaust air from the first spraying area 1A which retains a considerable amount of heat resulting from the temperature conditioning is reused as the temperature conditioned air to be introduced in horizontal directions into the second spraying area 1A for automatic spraying operations.

In the drawings, reference numbers 20A and 20B denote air feed fans, number 21A and 21B denote exhaust fans, number 22A denotes an exhaust duct for outwardly releasing part of the mistless exhaust air from the first spraying area 1A, number 22B denotes an exhaust duct for outwardly releasing exhaust air from the second spraying area 1B, number 23 denotes an intermediate filter, number 24 denotes flow control dampers, and number 20C denotes a booster fan.

As a different embodiment the spraying booth may comprise three or more spraying areas. In this case the apparatus may be simplified by providing a common blast duct which collects exhaust air dispossessed of paint mist from the respective spraying areas and returns the exhaust air thereto through side feed openings.

Depending on conditions of the mistless exhaust air, it may be advantageous for the side feed openings to receive a mixture of exhaust air from the spraying area with which the side openings are in communication and exhaust air from one or more of the other spraying areas.

The spraying booth according to this invention may be modified further as follows:

Varied specific constructions may be employed for the top feed openings 3, 3A and 3B receiving a supply of fresh temperature conditioned air from the air conditioners 17, 17A and 17B and for side feed openings 4 and 4B receiving a supply of mistless exhaust air from the mist removing devices. The mist removing devices of the water purifying type as described may be replaced by dry type or other conventional devices.

Where desirable, the air feed of the paint mist may also be supplied through the top openings for the interest of engergy saving.

In order to provide a further improvement in the spraying booth, the invention proposes to automatically shift the exhaust position of the exhaust openings following the movement of the object under treatment, whereby the exhaust air is constantly discharged from right under the object whether the object is standing still or is moving. This aspect will particularly be described hereinafter referring to FIGS. 11 through 14.

The exhaust openings 5 comprise a plurality of exhaust slits **5*a* arranged right under the object A in the spraying position and distributed substantially over an entire region including a horizontal plane region X of projection of the object A and its adjacent peripheral regions, and a plurality of exhaust slits 5*b*** juxtaposed in a direction of object conveyance over an entire extension region downstream of the abovementioned region under the standing object A with respect to the direction of object convenyance. The extension region has a predetermined distance Y in the direction of object convenyance measured from a downstream end of the region under the standing object A and is flush at right and left edges with the region under the standing object A.

Each of the slits **5*b* in the extension region has a lid 51 and an actuator cylinder 52 to open and close the lid 51. The automatic control unit 26 operable according to the preset program to drive the spraying robots 7 and the conveyor 2 in a coodinated manner includes a control circuit for automatically controlling the cylinders 52 to open and close the lids 51 in association with the conveyor 2. The slits 5*b* in the extension region are all closed when the object A is at the spraying position. As the object A is conveyed from the spraying position, a most upstream slit 5*b* is opened first, then a next slit and so on with the advance thereover of the object A. In other words, the slits 5*b* are opened one after the other from upstream to downstream with respect to the object conveying direction and in synchronism with the advance of the object. The slits 5*b*** in the extension region are all closed again when the next object A' arrives at the spraying position.

By automatically shifting the exhaust position of the exhaust openings 5 in sychronism with the advance of the object A from the spraying position so that the exhaust position is constantly located right under the object A as described, residual paint mist floating below the object and tending to move with object as the latter is moved after the spraying treatment is discharged effectively.

The described device may be modified in various ways as follows. While the slits **5*b* in the extension region are opend successively from upstream to downstream to shift the exhaust position of the exhaust openings 5 as described, the slits 5*b* may also be closed successively from upstream to downstream as the slits 5*a* emerge from the position right under the moving object A. As an alternative arrangement to the foregoing example in which part of the slits 5*a* and 5*b* constituting the exhaust openings 5 are opened and closed in order to shift the exhaust position, the exhaust openings 5** per se may be movable following the movement of the object A.

The lids for opening and closing the slits **5*b*, a mechanism for moving the exhaust openings 5 per se and other mechanisms for shifting the exhaust position in the above various arrangements are collectively called herein a shifting device 51**.

The shifting distance Y of the exhaust position may be varied as appropriate.

Figure 14:
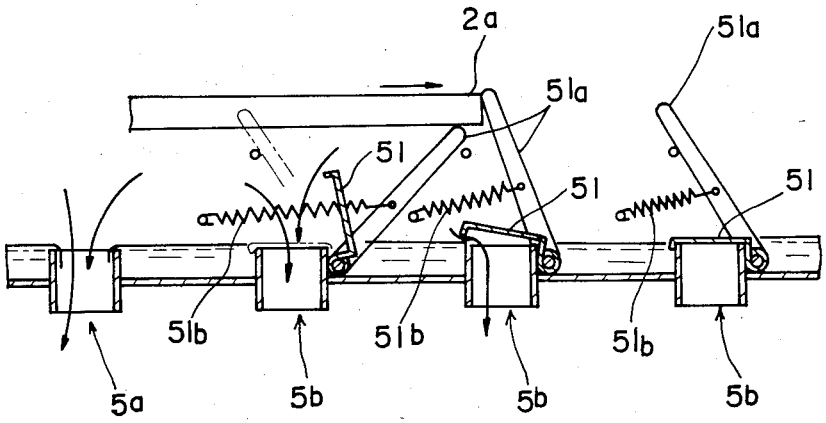
Figure 15:
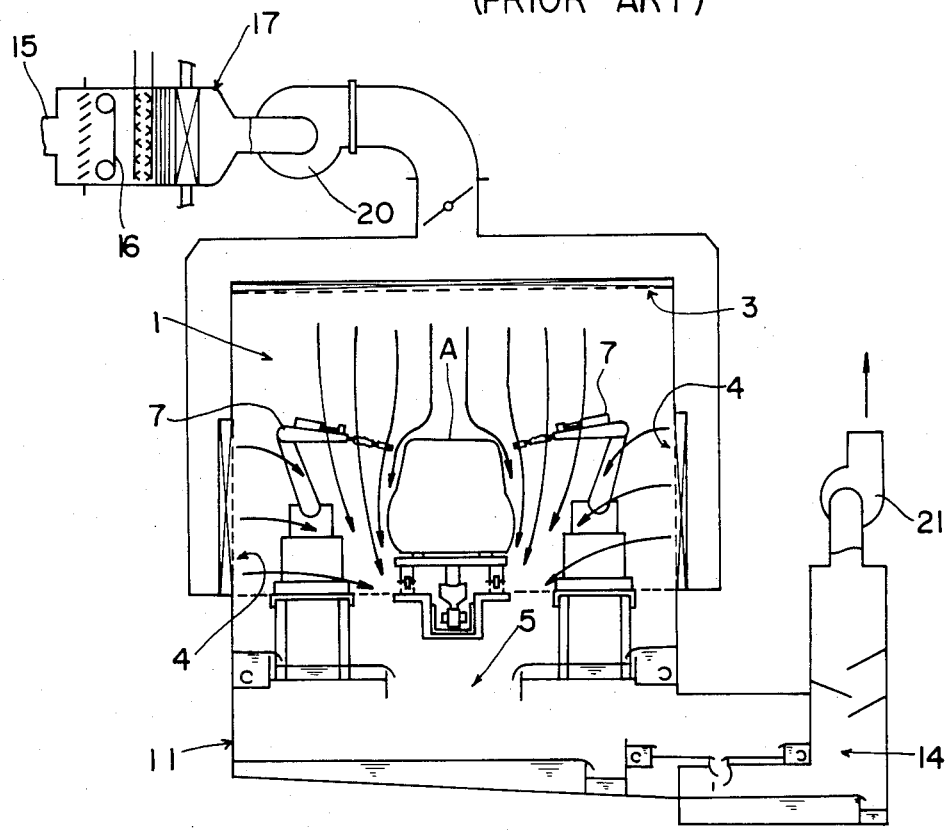
Fig .15 (PRIOR ART)

Various mechanical interlocking constructions may be employed instead of the automatic control to provide control signals for the actuating devices 52 to control the shifting device 51 in synchronism with the movement of the object A and in association with the conveyor 2. One such example of mechanical interlocking construction is shown in FIG. 14. In this example each of the lids 51 for opening and closing the slits **5*b* is provided with a control arm 51*a* adapted to contact an object carriage 2*a* or an object carrying portion of the conveyor 2. When the contact takes place the control arm 51*a* is forced against a spring 51*b* biasing the arm 51*a* toward a position to close the slit 5*b*, to open the slit 5*b* and keep the slit 5*b*** open while the slit is under the moving object A. The various automatic control arrangements including the above described constructions are collectively called herein an automatic control device.

The mist containing air is constantly exhausted from right under the painted object even when the object is being conveyed, by automatically shifting the exhaust position of the exhaust openings following the movement of the object as described. This permits the mist of overspray paint to be discharged as promptly as in the prior art when the object is at the spraying position, and at the same time causes the residual paint mist afloat below the object and tending to move with the object to be discharged from under the object continuously and effectively. The described construction is effective to prevent the floating paint mist resulting from the movement of the mist from remaining in the spraying area for a long time.

Consequently, the outgoing timing for the painted object is quickened to improve the object changing efficiency while positively preventing color migration from an object sprayed with one color to another object sprayed with another color due to the residual paint mist floating in the spraying area. The spraying booth according to this invention on the whole has a greatly improved efficiency of continuous spraying operation over the conventional spraying booth.

We claim:

1. A spraying booth comprising:

a spraying area (1) defined by a ceiling and side walls, top feed openings (3) for introducing a temperature conditioned air in laminar flows substantially through an entire area of the ceiling and downwardly into the spraying area (1), the top feed openings (3) being connected with a fresh air feed duct (18), exhaust means (5, 22) for removing overspray mist together with the temperature conditioned air from the spraying area (1) through a position below a painted object (A) standing at a spraying position in the spraying area (1), the exhaust means (5, 22) containing mist removing devices (11, 14), and side feed openings (4) formed at the side walls for introducing mistless air through the side walls in substantially horizontal directions into the spraying area (1) and connected with a mistless air feed duct (19) extending from the exhaust means (5, 22).

2. A spraying booth as claimed in claim 1 wherein the side feed openings (4) are adapted to receive the exhaust air from the spraying area (1) with which the side feed openings (4) are in communication.

3. A spraying booth as claimed in claim 1 wherein the side feed openings (4) are adapted to receive an exhaust air from a spraying area or areas other than the spraying area (1) with which the side feed openings (4) are in communication.

4. A spraying booth as claimed in claim 1 wherein the side feed openings (4) are adapted to receive a mixture of the exhaust air from the spraying area (1) with which the side feed openings (4) are in communication and an exhaust air from a different spraying area or areas.

5. A spraying booth as claimed in claim 1 wherein the feed duct (18) and the blast duct (19) include(s) flow control means.

6. A spraying booth as claimed in claim 5 further comprising automatic control means for controlling the flow control means.

7. A spraying booth as claimed in claim 6 wherein the automatic control means is adapted to control the flow control means such that an amount (W) of ventilating air introduced into the spraying area (1) and an amount (W') of exhaust air therefrom are increased during a period of time from completion of spraying operation for the object (A) to arrival at the spraying position of a next object, compared with amounts of ventilating air and exhaust air during the spraying operation.

8. A spraying booth as claimed in claim 7 further comprising a conveyor (2) for conveying the objects (A), wherein the automatic control means is adapted to control the flow control means such that the amount (W) of ventilating air introduced into the spraying area (1) and the amount (W') of exhaust air therefrom are automatically varied in association with automatic conveyance by the conveyor (2).

9. A spraying booth as claimed in claim 6 wherein the automatic control means is adapted to control the flow control means such that an amount (V) of ventilating air introduced downwardly into the spraying area (1) is increased and an amount (V') of ventilating air introduced in horizontal directions is decreased during a period of time from completion of a spraying operation for the object (A) to arrival at the spraying position of a next object, compared with the amounts introduced during the spraying operation, respectively.

10. A spraying booth as claimed in claim 9 further comprising a conveyor (2) for conveying the objects (A), wherein the automatic control means is adapted to control the flow control means such that the amount (V) of ventilating air introduced downwardly into the spraying area (1) and the amount (V') of ventilating air introduced in horizontal directions are automatically varied in association with automatic conveyance by the conveyor (2).

11. A spraying booth as claimed in claim 9 or 10 wherein the automatic control means is adapted to control the flow control means such that a sum of the amount (V) of ventilating air introduced downwardly and the amount (V') of ventilating air introduced in horizontal directions is maintained substantially constant.

12. A spraying booth as claimed in claim 1 further comprising means (51) for shifting an exhaust position defined by the exhaust openings (5) in a direction of conveyance of the object (A), wherein the shifting means (5) is automatically controllable such that the exhaust position is located under the object (A) in synchronism with conveyance of the object (A) by a conveyor (2).

13. A spraying booth comprising:

a spraying area (1) defined by a ceiling and side walls, top feed openings (3) for introducing a temperature conditioned air in laminar flows substantially through an entire area of the ceiling and downwardly into the spraying area (1), the top feed openings (3) being connected with a feed duct (18), side feed openings (4) for introducing the temperature conditioned air through the side walls in substantially horizontal directions into the spraying area (1), the side feed openings (4) being connected with a blast duct (19), and exhaust openings (5) for removing a mist of overspray paint together with the temperature conditioned air from the spraying area (1) through a position below a painted object (A) standing at a spraying position in the spraying area (1), wherein the top feed openings (3) are adapted to receive a temperature conditioned fresh air supply through the feed duct (18), and the side feed openings (4) are adapted to receive through the blast duct (19) an exhaust air having undergone a paint mist removing treatment, wherein the feed duct (18) and the blast duct (19) include flow control means, with automatic control means for controlling the flow control means, and wherein the automatic control means is adapted to control the flow control means such that an amount (W) of ventilating air introduced into the spraying area (1) and an amount (W') of exhaust air therefrom are increased during a period of time from completion of a spraying operation for the object (A) to arrival at the spraying position of a next object, compared with amounts of ventilating air and exhaust air during the spraying operation.

14. A spraying booth as claimed in claim 13 wherein the side feed openings (4) are adapted to receive the exhaust air from the spraying area (1) with which the side feed openings (4) are in communication.

15. A spraying booth as claimed in claim 13 wherein the side feed openings (4) are adapted to receive an exhaust air from a spraying area or areas other than the spraying area (1) with which the side feed openings (4) are in communication.

16. A spraying booth as claimed in claim 13 wherein the side feed openings (4) are adapted to receive a mixture of the exhaust air from the spraying area (1) with which the side feed openings (4) are in communication and an exhaust air from a different spraying area or areas.

17. A spraying booth as claimed in claim 13 further comprising a conveyor (2) for conveying the objects (A), wherein the automatic control means is adapted to control the flow control means such that the amount (W) of ventilating air introduced into the spraying area (1) and the amount (W') of exhaust air therefrom are automatically varied in association with automatic conveyance by the conveyor (2).

18. A spraying booth as claimed in claim 13 further comprising a conveyor (2) for conveying the objects (A), wherein the automatic control means is adapted to control the flow control means such that the amount (V) of ventilating air introduced downwardly into the spraying area (1) and the amount (V') of ventilating air introduced in horizontal directions are automatically varied in association with automatic conveyance by the conveyor (2).

19. A spraying booth as claimed in claim 18 wherein the automatic control means is adapted to control the flow control means such that a sum of the amount (V) of ventilating air introduced downwardly and the amount (V') of ventilating air introduced in horizontal directions is maintained substantially constant.

20. A spraying booth as claimed in claim 13 further comprising means (51) for shifting an exhaust position defined by the exhaust openings (5) in a direction of conveyance of the object (A), wherein the shifting means (5) is automatically controllable such that the exhaust position is located under the object (A) in synchronism with conveyance of the object (A) by a conveyor (2).

* * * * *